US011478042B2

(12) United States Patent
Klimberg et al.

(10) Patent No.: US 11,478,042 B2
(45) Date of Patent: Oct. 25, 2022

(54) COMFORTABLE FOOTWEAR

(71) Applicant: HCP Medical Supplies LLC, Galveston, TX (US)

(72) Inventors: V. Suzanne Klimberg, Galveston, TX (US); Kenneth Hoos, Chicago, IL (US); Robert F. Rioux, Ashland, MA (US)

(73) Assignee: HCP Medical Supplies LLC, Galveston, TX (US)

( * ) Notice: Subject to any disclaimer, the term of this patent is extended or adjusted under 35 U.S.C. 154(b) by 13 days.

(21) Appl. No.: 16/937,002

(22) Filed: Jul. 23, 2020

(65) Prior Publication Data

US 2021/0030111 A1 Feb. 4, 2021

Related U.S. Application Data

(60) Provisional application No. 62/879,635, filed on Jul. 29, 2019.

(51) Int. Cl.
*A43B 3/16* (2022.01)
*A43B 13/18* (2006.01)

(52) U.S. Cl.
CPC ..... *A43B 13/186* (2013.01); *A43B 3/16* (2013.01)

(58) Field of Classification Search
CPC ..... A43B 3/16; A43B 13/36; A43C 13/12
USPC ..... 36/15, 62, 7.1 R
See application file for complete search history.

(56) References Cited

U.S. PATENT DOCUMENTS

| | | | | |
|---|---|---|---|---|
| 3,011,272 | A | 12/1961 | Goldenberg | |
| 3,561,140 | A * | 2/1971 | Ludwig | A43C 15/02 36/59 R |
| 3,693,269 | A * | 9/1972 | Guarrera | A43B 13/32 36/15 |
| 3,903,620 | A * | 9/1975 | Gillet | A43C 13/12 36/25 R |
| 6,640,465 | B1 * | 11/2003 | Burgess | A43B 7/141 36/15 |
| 10,398,195 | B1 | 9/2019 | Donaghue | |
| 10,653,207 | B1 * | 5/2020 | Ochipa | A43B 13/32 |
| 2005/0011084 | A1 * | 1/2005 | Stephenson | A43B 13/226 36/15 |
| 2006/0207123 | A1 * | 9/2006 | Milner | A43B 1/0045 36/44 |
| 2008/0163518 | A1 * | 7/2008 | Pettis | A43B 13/36 36/30 R |
| 2008/0282577 | A1 * | 11/2008 | Holeyfield | A43C 15/04 36/7.1 R |
| 2011/0047815 | A1 * | 3/2011 | Asquith | A43B 17/105 36/15 |
| 2012/0216428 | A1 * | 8/2012 | Marandos | A43B 13/122 36/130 |

(Continued)

OTHER PUBLICATIONS

International Search Report and Written Opinion issued in International Application No. PCT/US2020/043251, dated Nov. 30, 2020, 12 pages.

*Primary Examiner* — Marie D Bays
(74) *Attorney, Agent, or Firm* — Brown Rudnick LLP

(57) ABSTRACT

The invention generally relates to removable outsole cushion attachments and shoe covers that are cushioned and disposable. The removable outsole cushion attachments and shoe covers can be used by healthcare professionals and others to achieve comfort and eliminate or at least reduce the fatigue associated with standing for long periods of time.

14 Claims, 18 Drawing Sheets

(56) References Cited

U.S. PATENT DOCUMENTS

| | | | | |
|---|---|---|---|---|
| 2013/0042422 | A1* | 2/2013 | Neal | A43B 13/22 12/103 |
| 2014/0041257 | A1* | 2/2014 | Robinson | A43B 3/244 36/100 |
| 2015/0113835 | A1* | 4/2015 | Rosenberger | A43B 3/244 36/136 |
| 2016/0143508 | A1* | 5/2016 | McGrath | A47L 25/005 15/104.002 |
| 2017/0318909 | A1* | 11/2017 | Gilbert | A43B 13/122 |
| 2019/0116918 | A1* | 4/2019 | Yeakim | A43B 1/009 |
| 2020/0390190 | A1* | 12/2020 | Kuo | A43B 3/126 |
| 2021/0000214 | A1* | 1/2021 | Booker | A43B 3/00 |
| 2021/0059346 | A1* | 3/2021 | Li | A43B 3/108 |

* cited by examiner

COMFORTABLE FOOTWEAR

FIELD

The present disclosure relates generally to comfortable shoes that eliminate or at least reduce the fatigue associated with standing for long periods of time while wearing shoes.

BACKGROUND

It is well documented that certain healthcare professionals (HCPs) spend a significant amount of time in a static posture and/or standing for a significant amount of time. As a result, these professionals experience substantial stress to their musculoskeletal system. This stress is directly related to lower extremity fatigue with concurrent effects extending up the human body through the lower extremities, lumbar region, head, and neck region, as well as shoulders and upper extremities. As an example, those who work in a surgical environment must wear protective wear in order to enter into the surgical suite area.

Anti-fatigue floor mats are known and used to improve ergonomics in surgery and other human tasks that require prolonged static postural positioning and/or standing for a significant amount of time. When placed on the floor in an operating room, such mats allow surgeons to perform surgical procedures with no, little, or at least reduced musculoskeletal fatigue. It also is common for step stools used in the operating room to have an anti-fatigue surface to provide the surgeons with the same benefits when standing on one or more of the step stools during a surgical procedure.

An anti-fatigue mat or step stool can be purchased in different sizes, but when placed in a surgical operating room the mat or step stool covers only a very small area of the entire floor of the operating room. For example, a typical anti-fatigue mat is rectangular in shape and about 24 inches by 18 inches with a thickness of about a half of an inch. One or more anti-fatigue mats can be placed on the floor at the side(s) of an operating table where the surgeon or HCP will stand during a procedure in the operating room. The operating room also may have in it one or more anti-fatigue step stools. Because the majority of the floor in the operating room usually has nothing on it, the other healthcare professionals in the operating room must stand directly on the floor and not on any anti-fatigue mat or step stool. Even the surgeon may not always be standing on an anti-fatigue mat or step stool during the entire surgical procedure in the operating room because a surgeon may move around the operating table during a procedure.

Also, while an operating room is cleaned after each surgical procedure that is performed in the room, any anti-fatigue mats and step stools in the operating room typically do not get cleaned thoroughly. The use of these mats and step stools in the operating room thus raises concerns about sanitation and contamination, and the cleaning of such mats exposes the cleaning crew to increased contamination. Furthermore, moving the mats around for proper cleaning and not re-installing them properly can lead to tripping and falling accidents in the operating room.

HCPs or anyone entering a surgical suite is required to wear their surgical only footwear or must cover their footwear with disposable shoe covers. Currently, none of these footwear covers offer sole support or cushion.

SUMMARY

The invention generally relates to improvements in footwear to make healthcare professionals (HCPs) and others more comfortable when on their feet for long periods of time. The invention helps eliminate or at least reduce the fatigue a person experiences by being on their feet for a long period of time.

One embodiment of the invention involves outsole cushion attachments releasably attachable to footwear. Each outsole cushion attachment is releasably attachable to an outsole of footwear, and is thus a removable attachment. The removable footwear attachments are cushioned and disposable. HCPs (such as surgeons, nurses, technicians, industry representatives, and others) can use the disposable cushioned shoe attachments to achieve comfort and eliminate or at least reduce the fatigue associated with standing for long periods of time in an operating room, and other people can get the same benefit in other settings that require being on their feet for a long period of time. When the disposable outsole cushioned attachments are used, there is no need for anti-fatigue mats or anti-fatigue step stools that are commonly found in hospital operating rooms, although the inventive attachments can be used with any anti-fatigue mats and/or step stools that might be present in an operating room. These inventive outsole attachments are designed to be single-use, disposable items. An attachment according to the invention is releasably attached to the bottom of the outsole of a person's footwear (such as a shoe or a shoe cover) before or soon after the person enters a work area (such as a surgical operating room in a hospital). After the task in the work area is completed (such as the end of a surgical procedure in an operating room), the attachment can be removed easily from the outsole of the person's footwear and discarded. In a surgical operating room setting, the single use/disposability aspect of the inventive attachment addresses the sanitary and contamination concerns presented by not-thoroughly-cleaned anti-fatigue mats and step stools in the operating room.

Another embodiment of the invention involves shoe covers. Known shoe covers are used in the healthcare field and a variety of other industries, including painting, carpentry, teaching, construction, and to name some. A typical shoe cover that is worn over each piece of footwear of a HCP in a surgical operating room can have, in accordance with the invention, a cushioned component attached to or formed integrally with it. This embodiment of the invention involves the placement of a cushioned component on the outsole (i.e., exterior surface) of a shoe cover, attached to the inside of a shoe cover, or in (or integrated into) a shoe cover to make a new disposable shoe cover that provides to a wearer the benefit of eliminating or at least reducing the fatigue associated with standing for long periods of time. The new inventive shoe cover is discarded once the wearer is finished wearing it.

In its simplest form, an outsole cushion attachment in accordance with the invention can include a cushioning section and a release layer for releasably attaching the attachment to an outsole of footwear. The attachment may also include an upper layer, wherein the release layer is disposed thereon and a lower layer. The cushioning section may be disposed between the upper and lower layers. The release layer can have an adhesive portion configured to releasably attach the attachment to the outsole of the footwear. The release layer may include a tab that extends beyond an edge of the attachment to allow a person to manually peel the attachment from the outsole of the footwear. The tab may be non-adhesive. The footwear may be any type of foot covering. For example, the footwear may be a shoe or a shoe cover.

The inventive disposable cushioned footwear attachment can be used for any shoe size. For example, the attachment may include one or more trim lines that indicate where to cut the attachment to make the attachment smaller and thus allow the shoe attachment to be used with a shoe of any size or type. The inventive disposable cushioned footwear attachment also can take different shapes such that it is removably attachable to an entire outsole of a shoe or shoe s or only a portion of a shoe's outsole. For example, one attachment can be shaped to be removably attached to a heel area of a shoe's outsole, and another attachment can be shaped to be removably attached to that shoe outsole's toe area.

The cushioning section of the inventive disposable outsole cushion attachment aids in the attachment's ability to provide comfort and reduce foot fatigue associated with standing for long periods of time. The cushioning section of the attachment can be composed of an absorbable material or a compressible material, or any combination thereof. For example the absorbable material may be cotton, comminuted wood pulp, crimped polyester fibers, tissue or combinations thereof . . . . For example, the compressible material may be formed from any one of polyether, polyesters, polyethylene, polyurethane, latex, cellulose, polypropylene, nitrile, vinyl, silicone, elastomers, or any mixtures thereof. The compressible material may be a thermoplastic elastomer. The compressible material can be in the form of a gel or a foam. The cushioning section may be composed of at least one layer of an absorbable or compressible material(s) or a plurality of layers of absorbable or compressible material(s) to provide additional comfort.

The cushioning section can include a plurality of cup-shaped cutouts, thus providing additional comfort and shock-absorbing support. As such, the upper layer may also include a plurality of cutouts corresponding to the plurality of cup-shaped cutouts of the cushioning section. The upper layer may also include a plurality of adhesive rings lining a circumference of each of the plurality of cutouts of the upper layer, thereby providing additional adhesion of the attachment to an outsole of footwear. Accordingly, the release layer is configured to allow each of the plurality of adhesive rings to releasably attach to the outsole of the footwear. As such, the shoe attachment is intended to be securely, but also releasably attached to the outsole of the footwear.

The inventive disposable outsole cushion attachment is intended for use in environments where fluid is present, such as on the ground surface or on existing cushioning surfaces, like anti-fatigue mats. For example, blood and/or saline solutions may be on the floor of an operating room floor, or cooking grease may be on the floor of a kitchen. To account for such environments, the lower layer can be configured to increase friction between the attachment and a contact surface, such as the floor or a mat.

The inventive disposable outsole cushion attachment also can be treated with an anti-bacterial substance to reduce the spread of bacteria and thus help in maintaining a sterile or more sterile environment.

A shoe cover in accordance with the invention can be disposable and include a shoe cover body configured to securely fit over a shoe. The shoe cover body of the inventive disposable shoe cover includes a cushioned bottom. The cushioned bottom may include an upper layer, a lower layer, and a cushioning section disposed between the upper layer and lower layer. The cushioned bottom can be permanently or removably attached to the shoe cover, or the cushioned bottom can be formed integrally as part of the shoe cover.

The cushioned bottom of the inventive disposable shoe cover may include a release layer disposed on the upper layer, and the release layer may have an adhesive portion configured to releasably attach to the outsole of the shoe being covered. The release layer may include a tab that extends beyond an edge of the cushioned bottom to allow a person to release the cushioned bottom from the outsole of the shoe. The tab may extend through to an exterior surface of the shoe cover body to make it easy for a wearer of the shoe cover to manually peel the cushioned bottom from the outsole of the shoe to remove the entire shoe cover from the shoe.

BRIEF DESCRIPTION OF THE DRAWINGS

FIG. 5A is a top view of an upper layer of one embodiment of a removable outsole cushion attachment; FIG. 5B is a top view of a release layer of one embodiment of a removable outsole cushion attachment, illustrating an adhesive portion on the release layer and a tab extending past an edge of the release layer; and FIG. 5C is a bottom view of an outsole of a shoe;

DESCRIPTION

The invention generally relates to both a removable outsole cushion attachment and a shoe cover, each of which is cushioned and disposable. The removable outsole attachments and shoe covers can be used by healthcare professionals (HCPs) and others to achieve comfort and eliminate or at least reduce the fatigue a person experiences by being on his or her fee for a long period of time.

Figure 1:
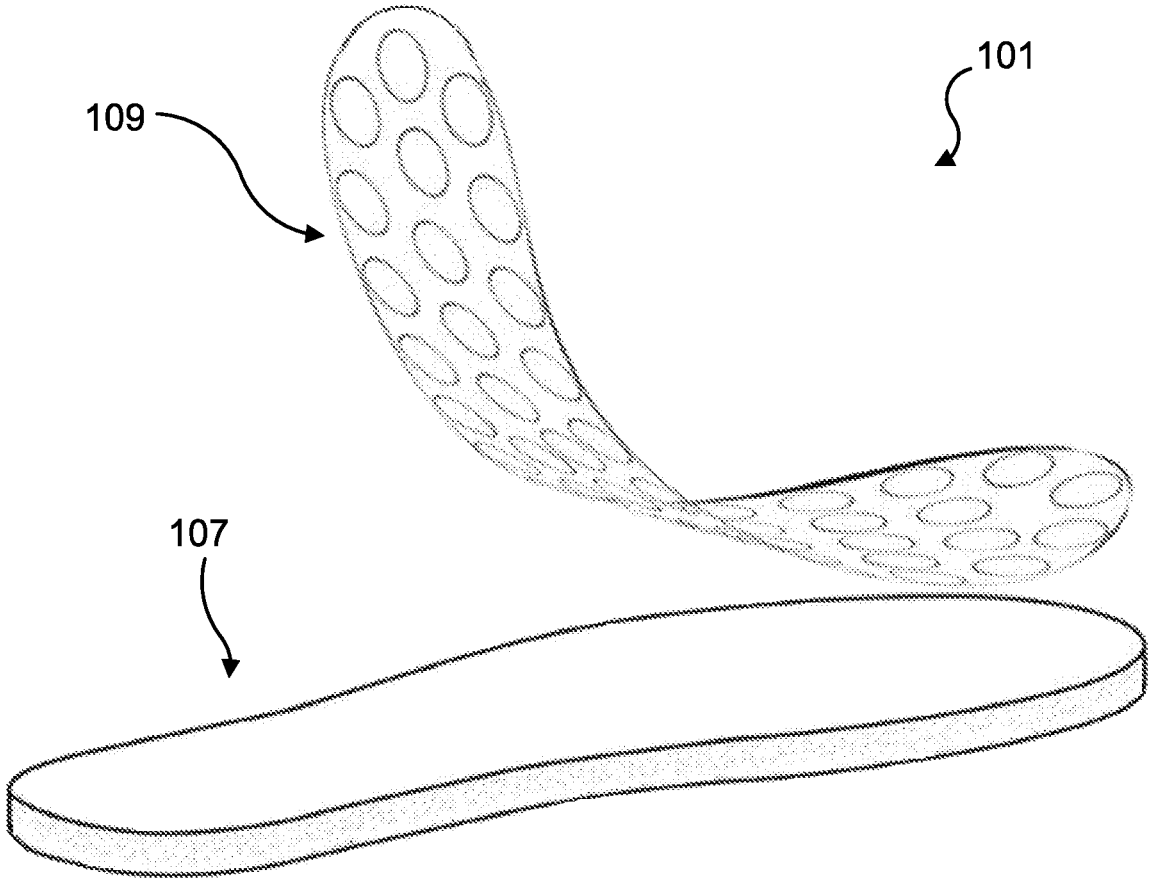
FIG. 1 is a perspective, exploded view of an embodiment of a removable outsole cushion attachment consistent with the present disclosure.

FIG. 1 is a perspective, exploded view of an exemplary embodiment of a removable outsole cushion attachment 101 in accordance with one aspect of the invention. The removable outsole cushion attachment 101 provides improved comfort and reduced or eliminated fatigue that a person experiences when standing in shoes for a long period of time. In its simplest form, the attachment 101 includes a cushioning section 107 and a release layer 109 for releasably attaching the attachment to the outsole of footwear. The release layer 109 may be disposed directly on the top portion of the cushioning section 107.

The release layer 109 is configured to releasably attach to an outsole of footwear. As such, the attachment 101 does not permanently adhere to the outsole of footwear, but is instead configured to temporarily attach to an outsole of footwear via the release layer 109 until the wearer desires to remove the attachment 101 from her footwear. Thus, the attachment 101 is a removable attachment capable of being attached to the outsole of footwear.

Figure 2:
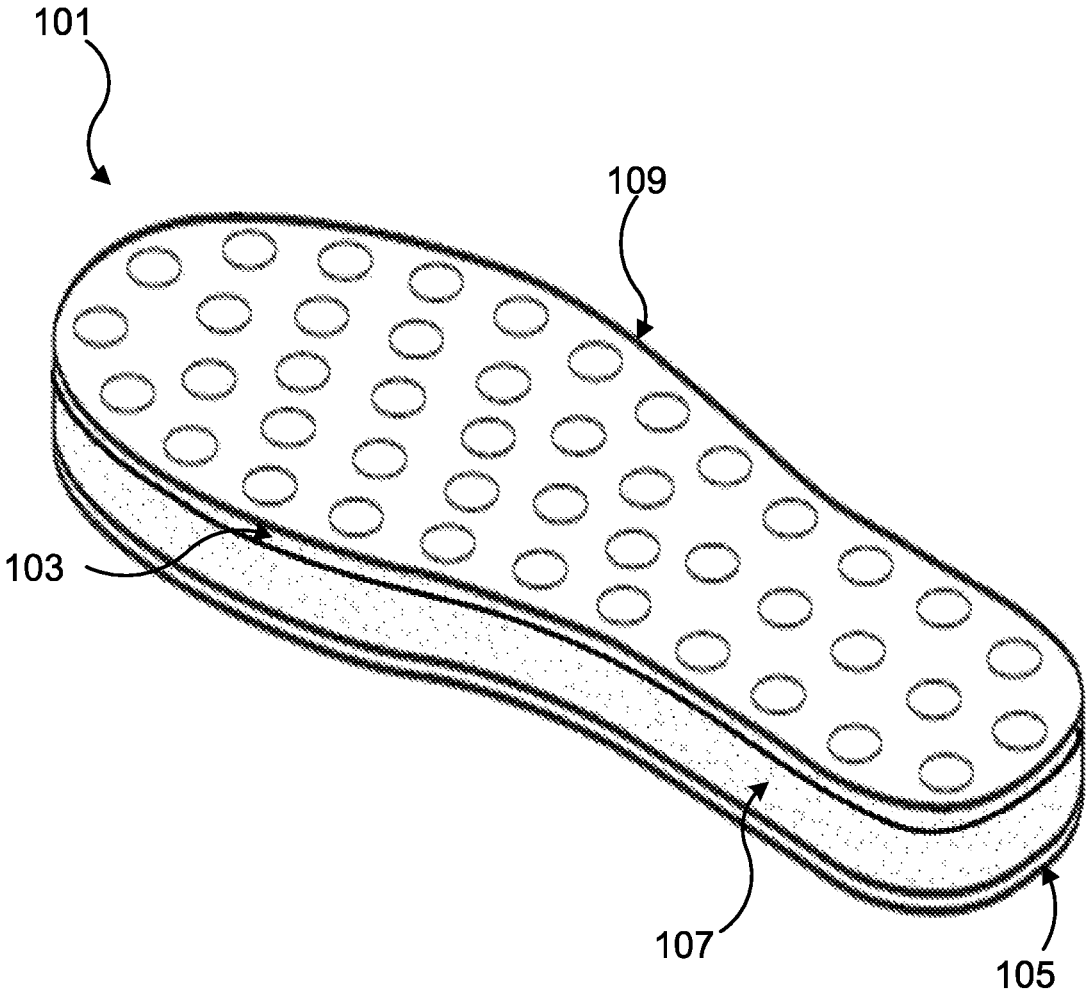
FIG. 2 is a perspective view of another embodiment of a removable outsole cushion attachment consistent with the present disclosure having layers.

FIG. 2 is a perspective view of the removable outsole cushion attachment 101. In some embodiments, the attachment 101 may also include an upper layer 103 and a lower layer 105. The cushioning section 107 is then disposed between the upper and lower layers 103, 105 respectively, and the release layer 109 may be disposed on the upper layer 103. The attachment 101 may be of many styles or configurations, however as illustrated in FIG. 1, the exemplary removable outsole cushion attachment 101 is illustrated with circles.

The removable outsole cushion attachment 101 is operable to be attached to any type of footwear or foot covering, e.g., a disposable shoe cover. For example, the footwear may be a shoe or a disposable shoe cover. The disposable shoe cover may be covering a shoe and the attachment 101 may be releasable attached to the shoe cover. Alternatively, the attachment 101 may be releasably attached to a shoe and a shoe cover may be placed over the shoe having the attachment 101 attached thereto, or both the shoe and the shoe cover may each have an attachment 101 releasably attached thereto.

Figure 3:
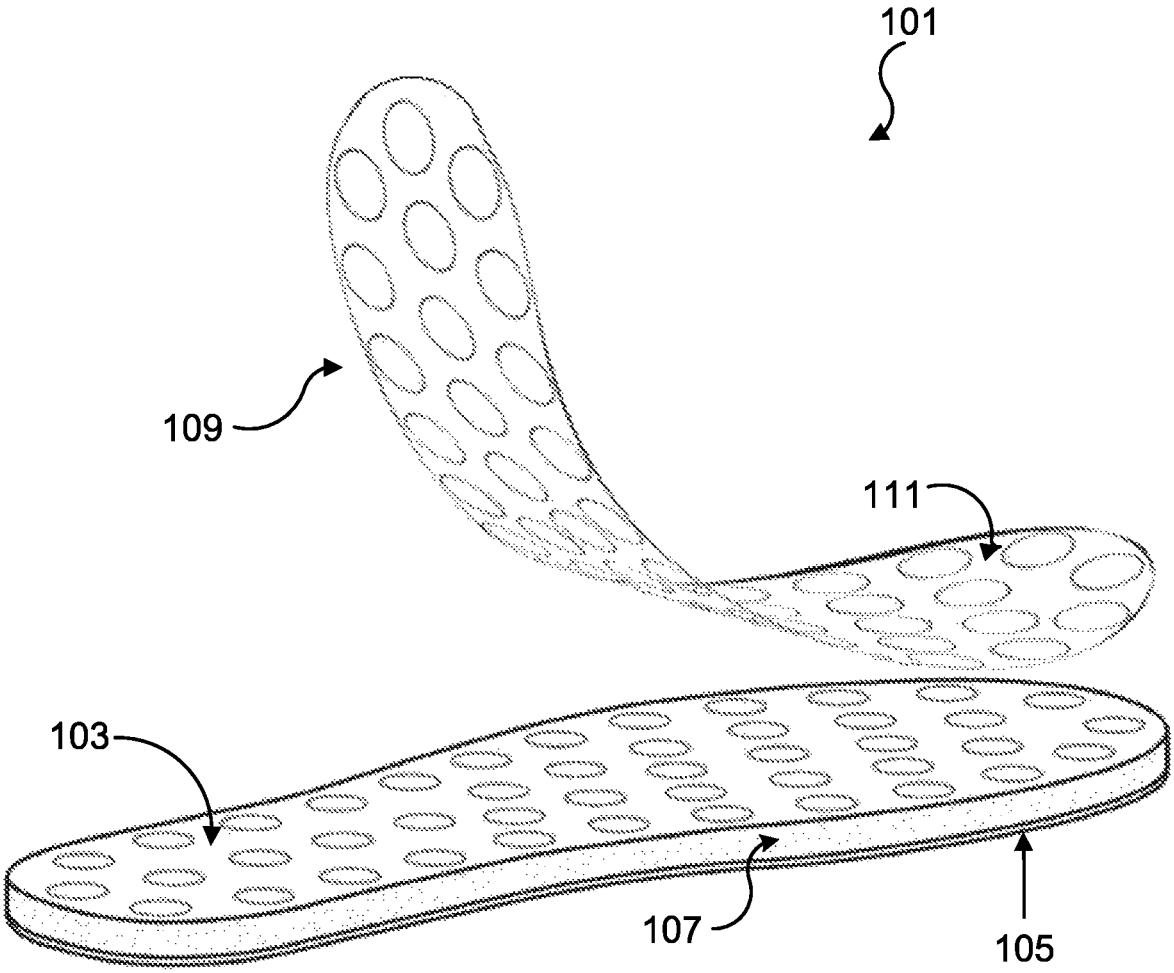
FIG. 3 is a perspective, exploded view of the attachment of FIG. 1, illustrating the release layer.

FIG. 3 is a perspective, exploded view of the removable outsole cushion attachment 101, focusing on the release layer 109. The release layer 109 may include an adhesive portion 111 configured to releasably attach the attachment 101 to the outsole of the footwear. The adhesive portion 111 may cover the entire surface of the release layer 109. In other embodiments, the adhesive portion 111 may only cover portions of the surface of the release layer 109.

The adhesive portion 111 may be comprised of any non-permanent or semi-permanent adhesive, or a combination thereof operable to bind the attachment 101 to the outsole of footwear and resist separation from the outsole until the wearer desires to remove it from the outsole of her shoe. For example, the adhesive may be a non-reactive adhesive operable to adhere to the outsole of footwear without the need of a chemical reaction to harden the adhesive. The adhesive may be a pressure-sensitive adhesive (i.e., a self-adhesive), that forms a bond when pressure is applied to bond the adhesive portion 111 of the release layer 109 to an adherend, i.e., an outsole of footwear. An adhesive operable with the attachment 101 may be an adhesive with some or all of the following properties: (i) aggressive and permanent tack, tack being a property that allows an adhesive to adhere to a surface under very slight pressure and determined by the ability of the adhesive to quickly wet the surface it contacts; (ii) ability to adhere to an outsole of a shoe with no more than light finger or stepping pressure; (iii) sufficient ability to hold onto the outsole of footwear; and (iv) sufficient cohesive strength to be removed cleanly from the outsole of the footwear. The adhesive may be formulated with a tackifier, e.g., a silicate tackifying resin. For example, the adhesive may be a polydiorganosiloxane polyoxamide formulated with a tackifying resin.

A protective liner (not shown) may be disposed on the release layer 109 and peeled away to expose the adhesive portion 111. Upon removal of the liner (not shown), the attachment 101 may then pressed onto the outsole of footwear. To remove or release the attachment 101 from footwear, a user can peel the attachment away from the outsole of the footwear with a peel angle of anywhere between 180 degrees to 30 degrees. The attachment 101 may then be discarded after a single use.

Figure 4:
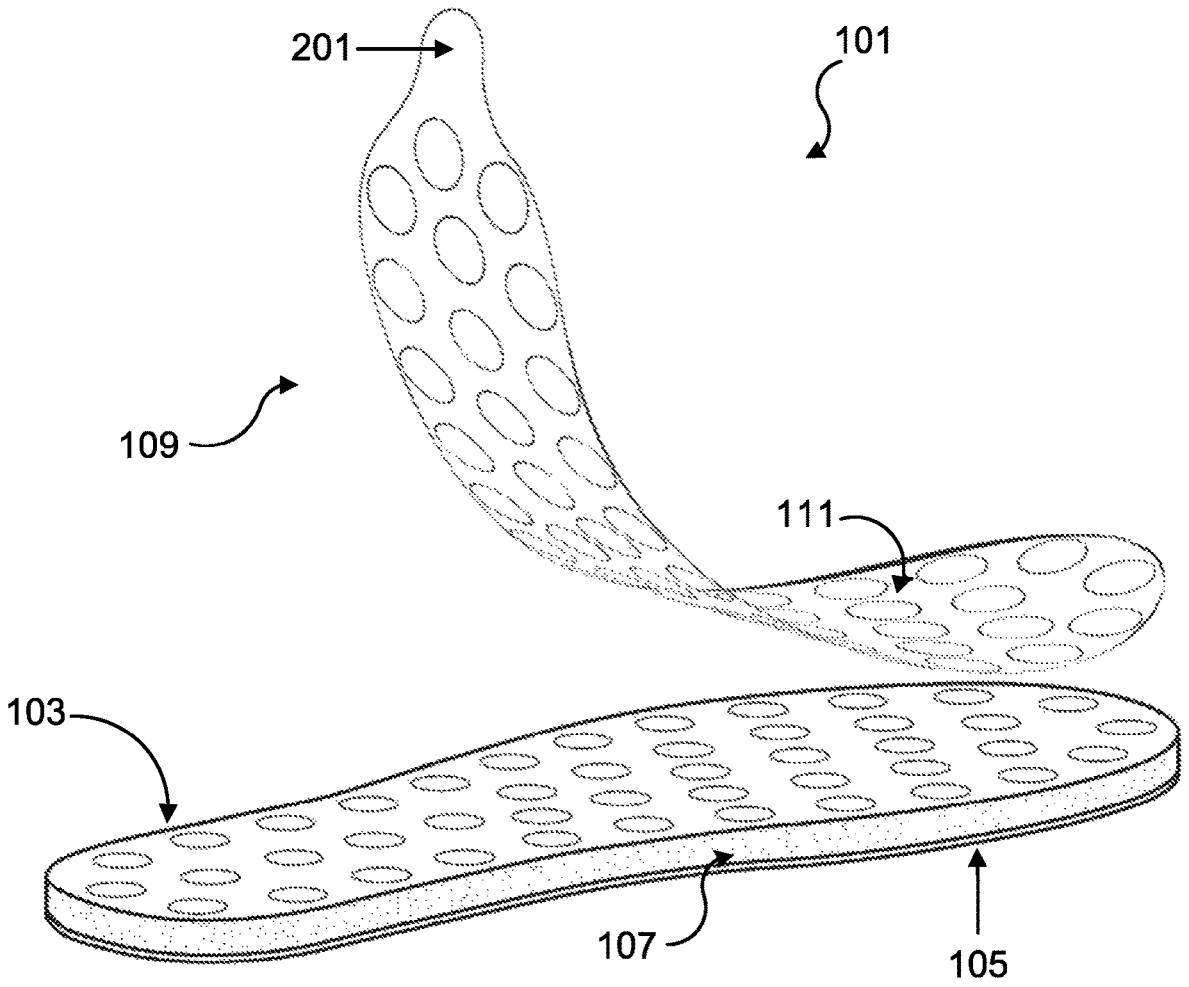
FIG. 4 is a perspective, exploded view of another embodiment of a removable outsole cushion attachment, illustrating the tab on the release layer.

FIG. 4 is a perspective, exploded view of an alternative version of the removable outsole cushion attachment 101 where the release layer 109 includes a tab 201 that extends beyond an edge of the attachment 101. The tab 201 may extend from any edge of the attachment 101 such as the edge of a heel portion of an attachment 101. The tab 201 is configured to be used by a person to release the attachment 101 from the outsole of the footwear. The tab 201 allows a user to manually peel the attachment 101 from the outsole of footwear, e.g., a shoe. The attachment 101 may then be discarded after a single use. The tab 201 may be a an adhesive-free tab that covers a portion of an adhesive portion 111 of the tab 201 to provide a way to grasp the release layer 109 for easy removal of the attachment 101 from the outsole of footwear. The tab 201 could be in the form of a loop (not shown) or other configuration, as long as it serves its purposes of being able to be grasped by a person and used to manually peel the attachment 101 from the outsole of the footwear.

The release layer 109 may be in the form of a releasable tape having an adhesive portion 111 comprising pressure-sensitive adhesive. The release layer 109 may be capable of being firmly bonded to an outsole of footwear via the adhesive portion 111, and further capable of being removed therefrom by stretching. For example, the release layer 109 may include a non-adhesive tab 201 configured to aid in removing the attachment 101 by allowing the user to stretch the tape that is or is a part of the release layer 109, thereby releasing the attachment 101 from the outsole of the footwear, without leaving residue. Suitable stretch releasing tapes are described in U.S. Pat. No. 4,024,312 (Korpman), German Patent No. 33 31 016, U.S. Pat. No. 5,516,581 (Kreckel et al.), and PCT International Publication 95/06691, the contents of each of which are incorporated by reference herein in their entireties. Commercial stretch releasing adhesive tapes include the product sold under the trade designation COMMAND by Minnesota Mining and Manufacturing Company, St. Paul, Minn., and the product sold under the trade designation POWER-STRIPS by Beiersdorf AG, Hamburg, Germany. These products are currently manufactured as discrete strips with one end of the strip including a non-adhesive pull tab to facilitate stretching of the strip during removal. The adhesive portion of the strip may also be protected with a release liner (not shown).

Figure 5A:
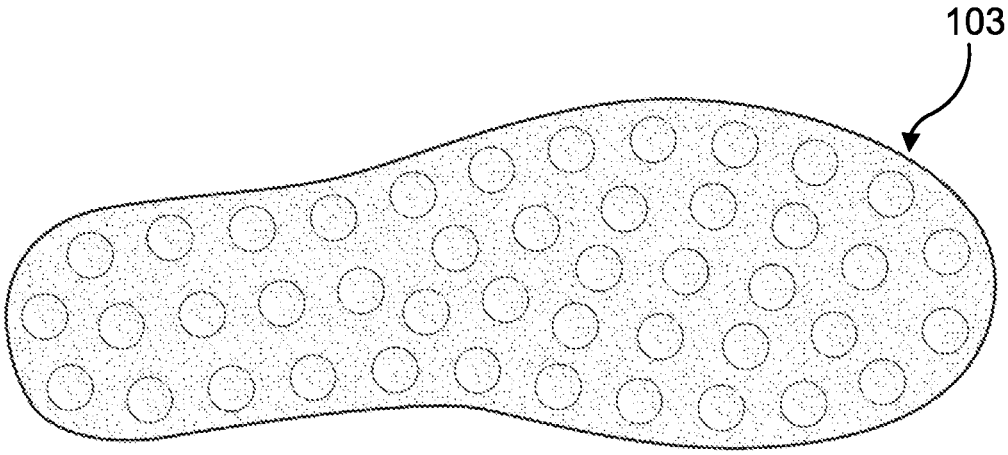
FIGS. 5A, 5B, 5C illustrate portions of an embodiment of a removable outsole cushion attachment consistent with the present disclosure after the attachment has been removed from an outsole of a shoe.
Figure 5B:
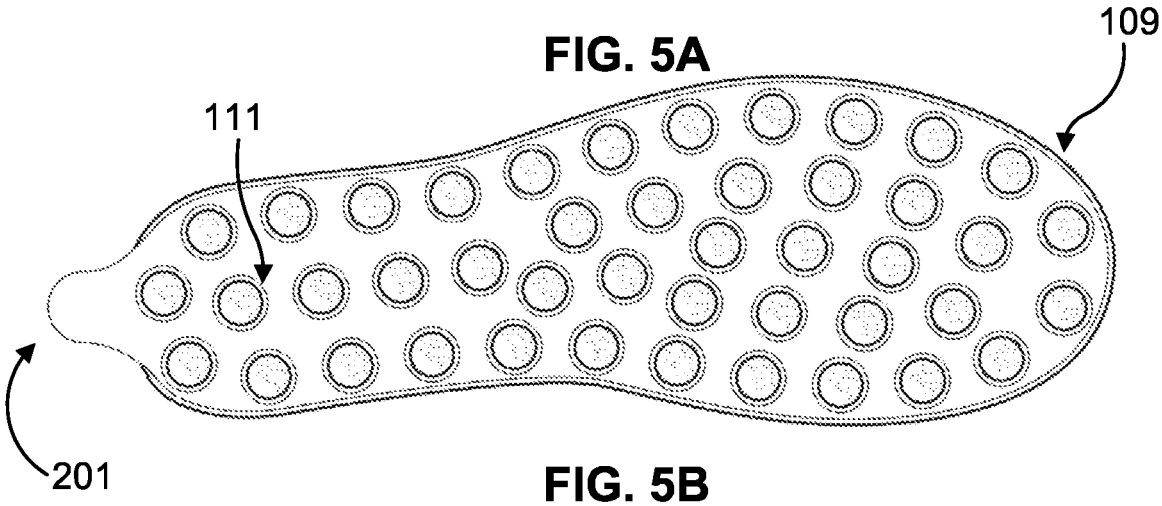
Figure 5C:
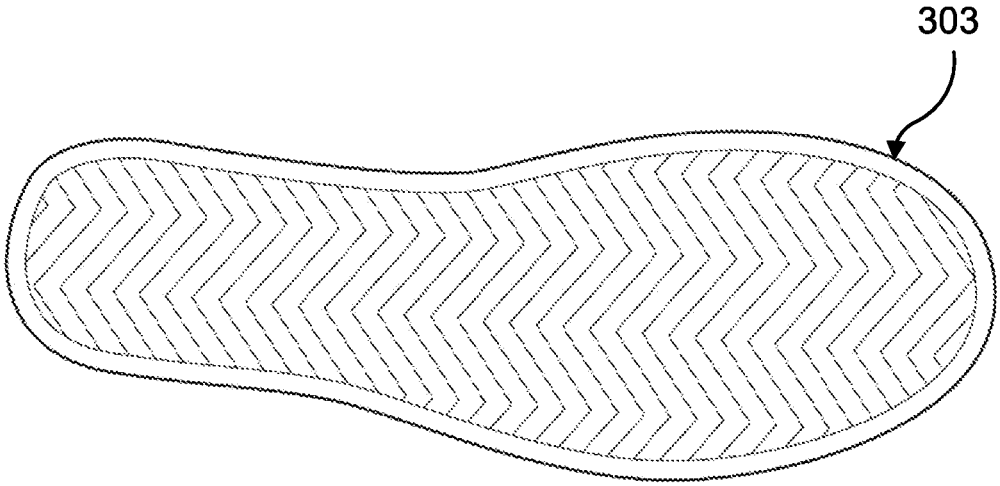

FIG. 5A is a top view of an upper layer 103 of one version of the attachment 101 without the release layer 109 affixed thereto. FIG. 5B is a top view of the release layer 109 having an adhesive portion 111, and a tab 201 of the attachment. FIG. 5C is a bottom view of an outsole 303 of an exemplary footwear, a shoe. Collectively, FIGS. 5A-5C portions of a used version of the attachment 101 and a clean outsole 303 of a shoe after a person removes the attachment 101 by grasping the tab 201 of the release layer 109 to disengage the attachment 101 from the outsole 303 of footwear. As depicted in FIG. 5A, the release layer 109 may become disengaged from the rest of the attachment 101 during removal of the attachment. As such, in certain aspects of the invention, the attachment 101 may be reusable by affixing a new release layer 109 to the upper layer 103.

Figure 6:
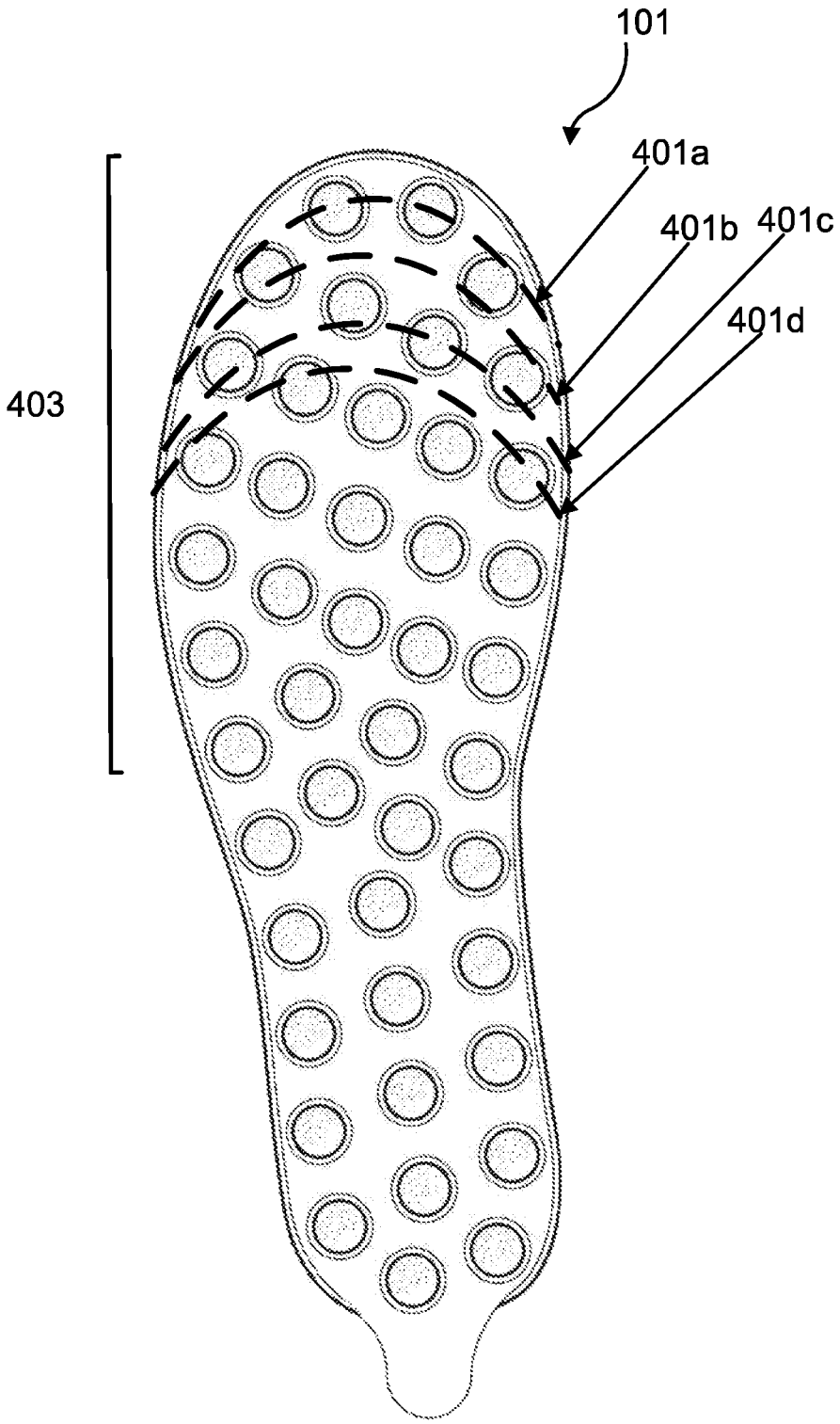
FIG. 6 is a top view of an embodiment of a removable outsole cushion attachment of the present disclosure depicting trim lines.

FIG. 6 is a top view of an alternative version of the removable outsole cushion attachment 101 of the present disclosure having trim lines 401. Typically, the removable outsole cushion attachment 101 would be sized corresponding to shoe sizes and would be provided in sized pairs. In this alternative version, the removable outsole cushion attachment 101 is configured so that it may be trimmed along trim lines 401 to a person's specific requirements or to fit the person's footwear, such as a shoe or a shoe covering. The pattern trim lines 401 may be formed on the lower layer 105 of a forefoot portion 403 of an attachment 101 and are representative of various sizes of a human foot. For example, the attachment 101 may be provided for a woman's shoe size of 11, with a first trim line 401*a* being representative of a smaller size attachment for a woman's shoe size of 10, second trim line 401*b* extending around the periphery of forefoot portion 403 indicative of another size of insole for a woman's shoe size 9, third trim line 401*c* extending around the periphery of forefoot portion 403 indicative of another size of attachment for a woman's shoe size of 8, a fourth trim line 401*d* extending around the periphery of forefoot portion 403 indicative of another size of attachment for a woman's shoe size of 7, and so on and so forth. If the wearer requires a size other than the original large size, the wearer trims the attachment 101 with a scissors or cutting instrument, following a trim line 401*a*, 401*b*, 401*c* or 401*d* to achieve the proper size. Alternatively, a trim line 401 may be in the form of perforations, so that a smaller size attachment 101 may be achieved by tearing along the appropriate trim line as facilitated by the perforations. As such, a forefoot portion 403 can be trimmed so that the attachment 101 extends a length of an entire outsole of a shoe. Trim lines 401 may also be included to adjust an attachment's width to fit a width of an outsole of a shoe. A plurality of trim lines 401 may be included to provide targeted removable shoe attachments. For example, a targeted forefront (i.e., ball of the foot) removable shoe attachment, a midsole (i.e., arch) removable attachment, a heel removable attachment, or any combination thereof.

Figure 7:
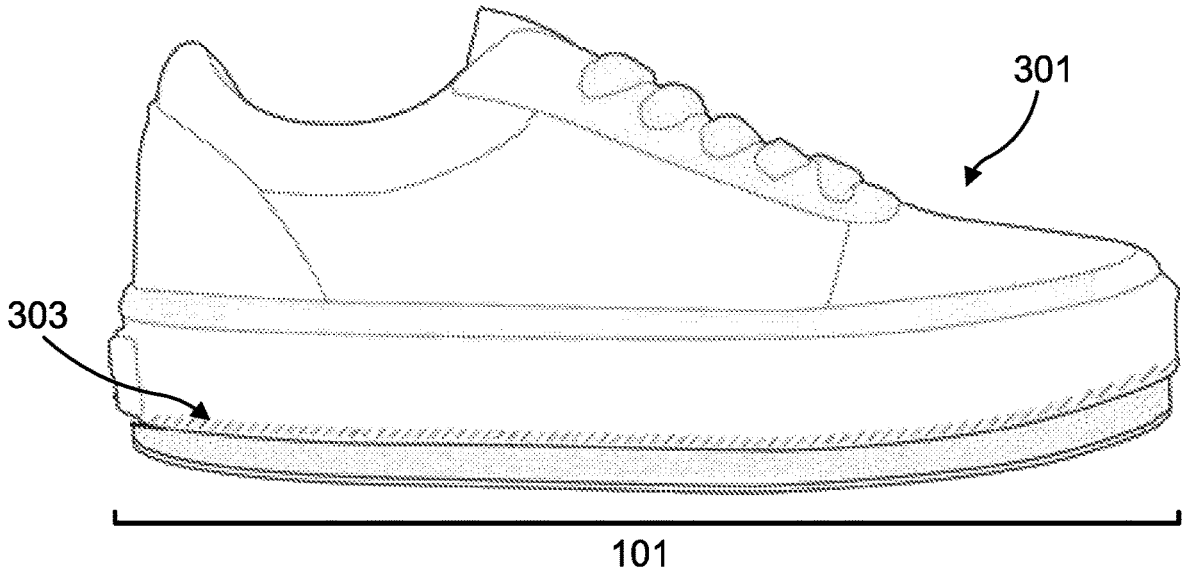
FIG. 7 is a side view of an embodiment of a removable outsole cushion attachment consistent with the present disclosure attached to the outsole of a shoe.

FIG. 7 is a side view of a version of the removable attachment 101 affixed to an outsole 303 of an exemplary piece of footwear, a shoe 301. The attachment 101 extends the length of the outsole 303 of the shoe 301 and does not extend further in either direction.

Figure 8A:
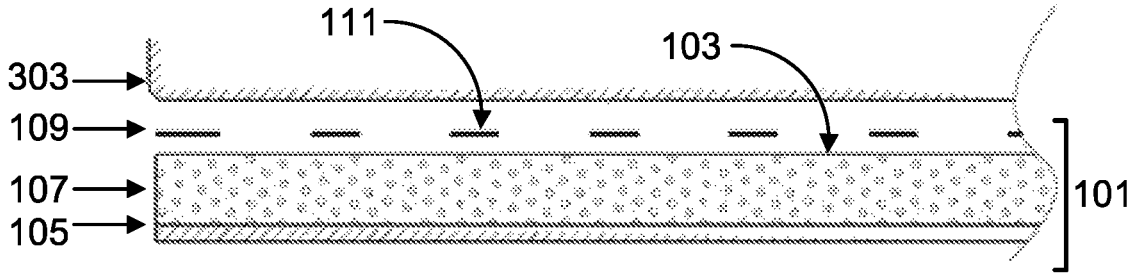
FIGS. 8A and 8B are cross-sectional views of the removable outsole cushion attachment of FIG. 7 in an uncompressed state and in a compressed state and affixed to an outsole of a shoe, respectively.

FIG. 8A is a cross-sectional view of a portion of the attachment 101 of FIG. 7 prior to the wearer affixing it to the outsole 303 her shoe 301. As depicted, the attachment 101 is in alignment with the outsole 303 of the shoe 301. Any protective liners (not shown) covering the adhesive portion 111 of the release layer 109 have been removed by the wearer so that the attachment 101 may be securely attached to the outsole 303 of the shoe 301. In this position, the cushion section 107 is in an uncompressed state and the lower layer 105 may or may not be in contact with a contact surface.

Figure 8B:
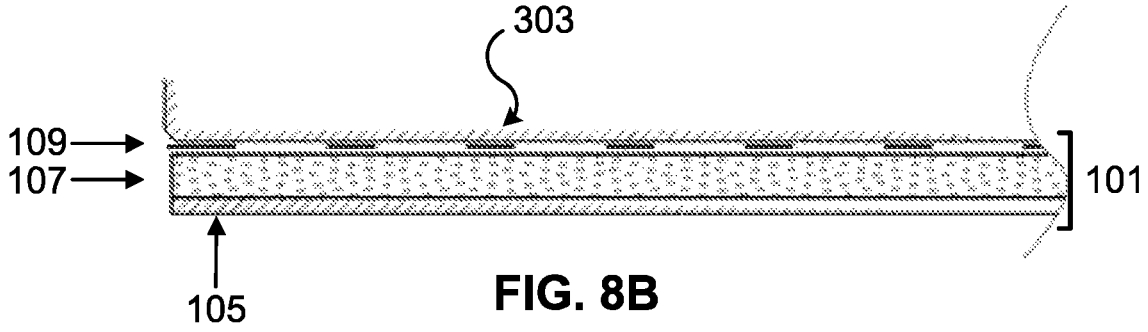

FIG. 8B is cross-sectional view of a portion of the attachment 101 of FIG. 7 affixed to the outsole 303 of a shoe 301. As depicted, upon compression by the wearer, either by stepping into the shoe 301 or by pressing the attachment 101 to the outsole 303 of her shoe with, for example, her hand, the attachment 101 adheres to the outsole 303. In this position, the cushion section 107 is in a compressed state and a lower layer 105 is in contact with a contact surface, for example an operating room floor, a stepping stool, or even a compression mat.

Figure 9:
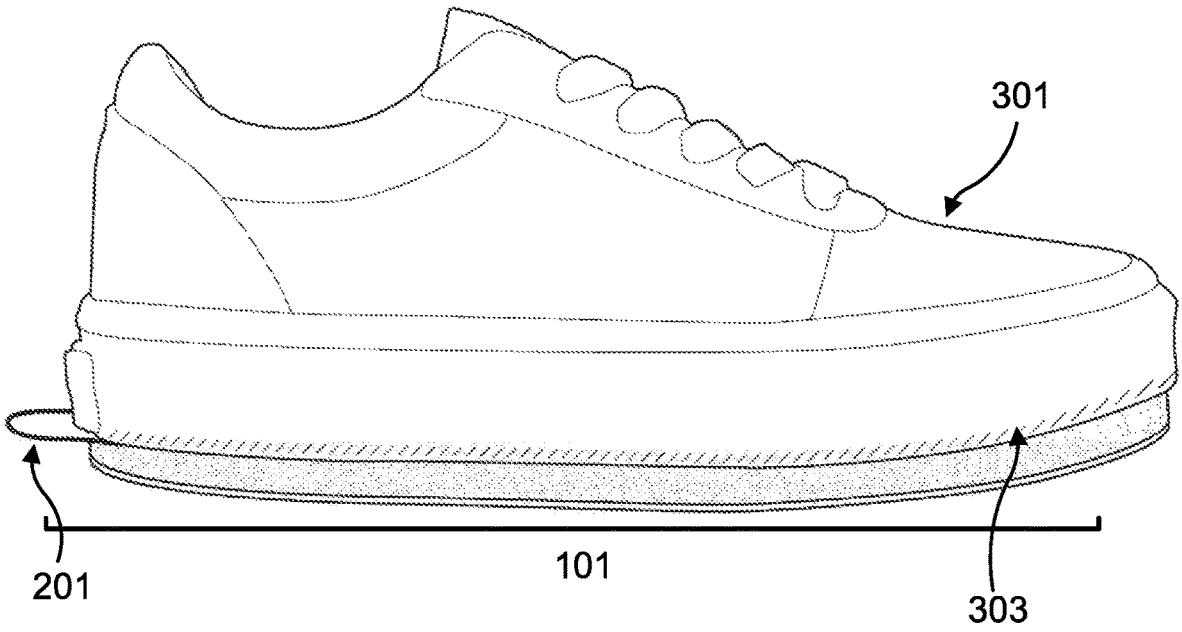
FIG. 9 is a side view of an embodiment of a removable outsole cushion attachment with a tab attached to the outsole of a shoe.

FIG. 9 is a side view of the alternative version of the removable attachment 101 where the release layer 109 includes a tab 201 of the present disclosure affixed to an outsole 303 of a shoe 301 having a tab 201. The attachment 101 extends the length of the outsole 303 of the shoe 301 and only the tab 201 extends past an edge of the outsole 303 of the shoe 301. In this version, the tab 201 extends past a heel portion of the shoe 301.

Figure 10A:
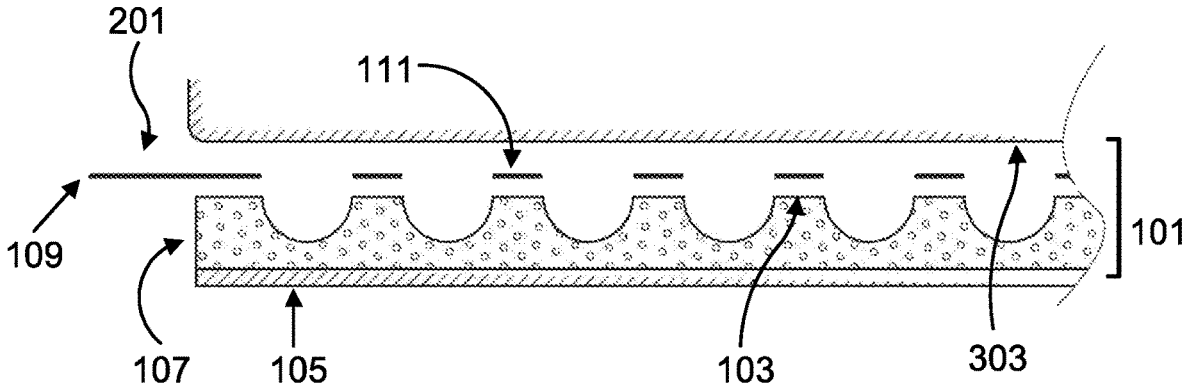
FIGS. 10A and 10B are cross-sectional views of the removable outsole cushion attachment of FIG. 9 in an uncompressed state and in a compressed state and affixed to an outsole of a shoe, respectively.

FIG. 10A is a cross-sectional view of a portion of the attachment 101 of FIG. 9 prior to the wearer affixing it to the outsole 303 her shoe 301. As depicted, the attachment 101 is in alignment with the outsole 303 of the shoe 301. Any protective liners (not shown) covering the adhesive portion 111 of the release layer 109 have been removed by the wearer so that the attachment 101 may be securely attached to the outsole 303 of the shoe 301. In this position, the cushion section 107 is in an uncompressed state and the lower layer 105 may or may not be in contact with a contact surface. The cushion section 107 may be comprised of layers of cushioning material and may include cutouts to provide shock absorbency, as further described later in this disclosure.

Figure 10B:
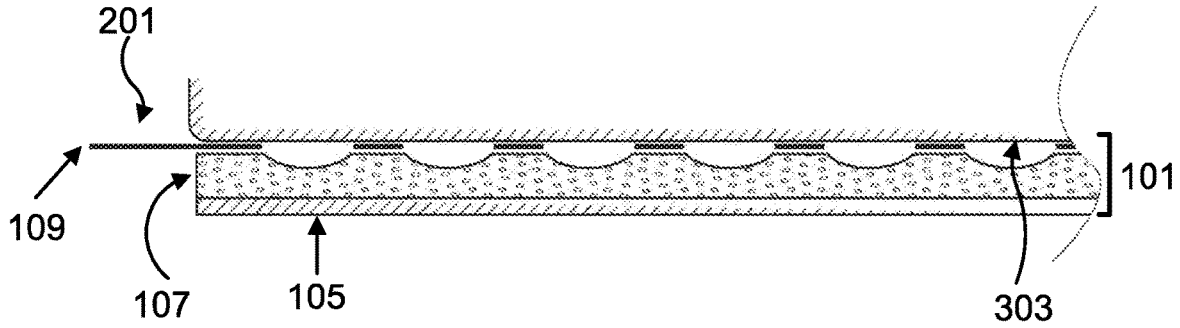

FIG. 10B is a cross-sectional view of a portion of the attachment 101 of FIG. 9 affixed to the outsole 303 of a shoe 301 illustrating the tab 201 extending past an edge of the outsole 303 of the shoe 301. As depicted, upon compression by the wearer by either stepping into the shoe 301 or by pressing the attachment 101 to the outsole 303 of her shoe with, for example, her hand, the attachment 101 adheres to the outsole 303 of the shoe 301. In this position, the cushion section 107 is in a compressed state and the lower layer 105 is in contact with a contact surface. The tab 201 is thus operable to allow the user to remove the attachment 101 form the outsole 303 of the shoe 301 without leaving unwanted residue on the outsole 303. The tab 201 is configured to be used by a person to release the attachment 101 from the outsole 303, such as by peeling or prying the attachment 101 away from the outsole 303 for removal, by stretching the releasable layer 109 thus disengaging it from the outsole 303 of the shoe 301, or by removing the releasable layer 109 from the attachment 101 and from the outsole 303 of the shoe 301.

The cushioning section 107 in accordance with the removable outsole cushion attachments of the present disclosure may be made of any absorbable or compressible material, or a combination thereof, that are known to provide cushioning. For example, the absorbable material may be formed form cotton, comminuted wood pulp, crimped polyester fibers, tissues or combinations thereof . . . . For example, the compressible material may be formed from any of polyether, polyesters, polyethylene, polyurethane, latex, cellulose, polypropylene, nitrile, vinyl, silicone, or elastomers, or any mixtures thereof. In preferred embodiments, the compressible material is a thermoplastic elastomer. For example, thermoplastic elastomers may be used to form the compressible material, such as materials made from many polymeric families, including but not limited to the Kraton family of styrene-olefin-rubber block copolymers, thermoplastic polyurethanes, thermoplastic poly olefins, polyamides, polyureas, polyesters and other polymer materials that reversibly soften as a function of temperature. The thermoplastic elastomers may be in the form of a gel or a foam.

The compressible material of the cushion section 107 may be in the form of a gel or a foam. A compressible gel material for the cushion section 107 of the present invention may have a low durometer, may be made from a non-foam elastomer having high levels of damping, or may be from the class of viscoelastic polymers or silicone gels. A compressible foam material for the cushion section 107 may be a closed-cell foam or an open-cell foam. In some embodiments, the foam is a closed cell-foam and may include cutouts therein to increase comfort.

The cushion section 107 is at least a single layer of an absorbable or compressible material. In some versions of the attachment 101, the cushion section 107 may be a plurality of layers of any of the materials described above. The cushioning section 107 may be a plurality of layers of an absorbable material or a compressible material, or a plurality of layers of different compressible materials. or absorbable materials For example, the cushion section 107 may have differing layers of compressible materials, such as gels, foams, or differing layers of absorbable materials, such as cotton or polyester fill, or a combination of differing layers of both compressible and absorbable materials. In other embodiments, different areas of the cushion section 107 may have differing levels of damping, density or thickness to provide maximum comfort to the wearer. The cushion section may be of any thickness that provides the wearer with comfort and reduces or eliminates fatigue. For example, the cushion section 107 may be of any thickness between ¼ inch to 3 inches thick so that when a wearer is standing on it, should partially but not fully compress. As such, the thickness of the cushion section may also promote balance.

Figure 11:
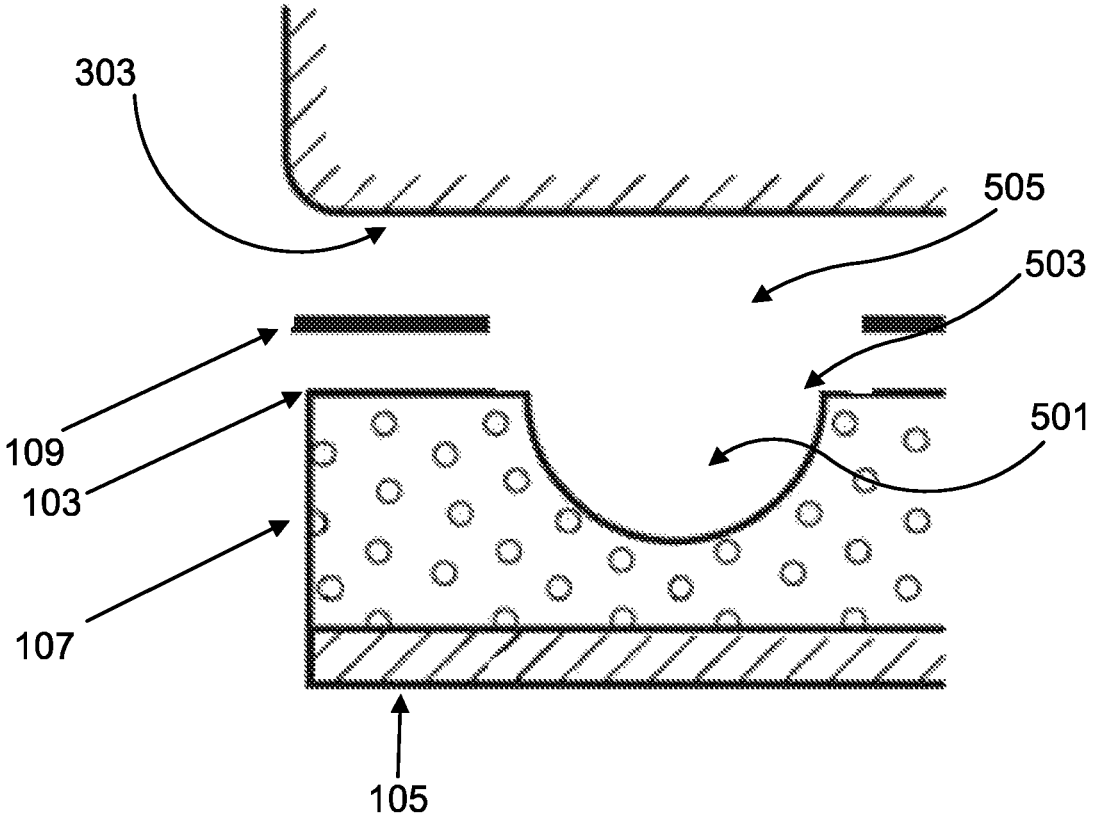
FIG. 11 is an enlarged cross-sectional view of an embodiment of a removable outsole cushion attachment consistent with the present disclosure illustrating a cushion section with plurality of cutouts.

FIG. 11 is an enlarged cross-sectional view of a portion of an alternative version of the attachment 101 having a cushion section 107 with a plurality of cutouts 501 therein. The plurality of cutouts 501 may be cup-shaped or may be hexagonal. The cutouts 501 may form a pattern in the cushion section 107, for example a honeycomb pattern. The upper layer 103 may cover the plurality of cutouts 501 of the cushion layer. The upper layer 103 may include a plurality of cutouts 503 corresponding to the plurality of cutouts 501 of the cushion section 107. The release layer 109 may also include a plurality of cutouts 505 corresponding to the plurality of cutouts 503 of the upper layer 103.

Figure 12:
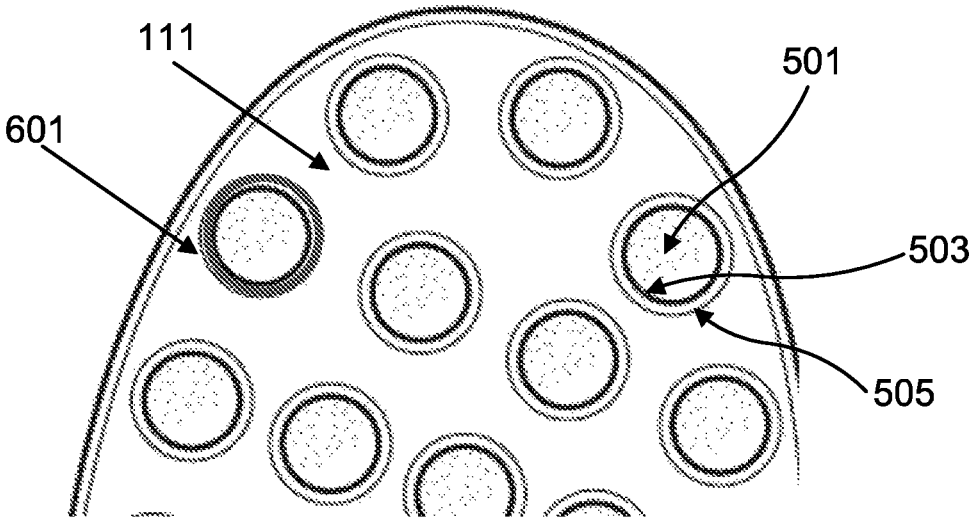
FIG. 12 is a top view of the attachment of FIG. 11 illustrating a top layer with adhesive rings.

FIG. 12 is a top view of an alternative version of the removable outsole cushion attachment 101 of FIG. 11 having a plurality of adhesive rings 601. The upper layer 103 has a plurality of cutouts 503 corresponding to the plurality of cup-shaped cutouts 501 of the cushioning section 107. The upper layer 103 also has a plurality of adhesive rings 601 lining a circumference of each of the plurality of cutouts 503 of the upper layer 103. The release layer 109 has a plurality of cutouts 505 further configured to allow each of the plurality of adhesive rings 601 to releasably attach to an outsole 303 a shoe, while also allowing the adhesive portion 111 to releasably attach to the outsole 303.

Figure 13:
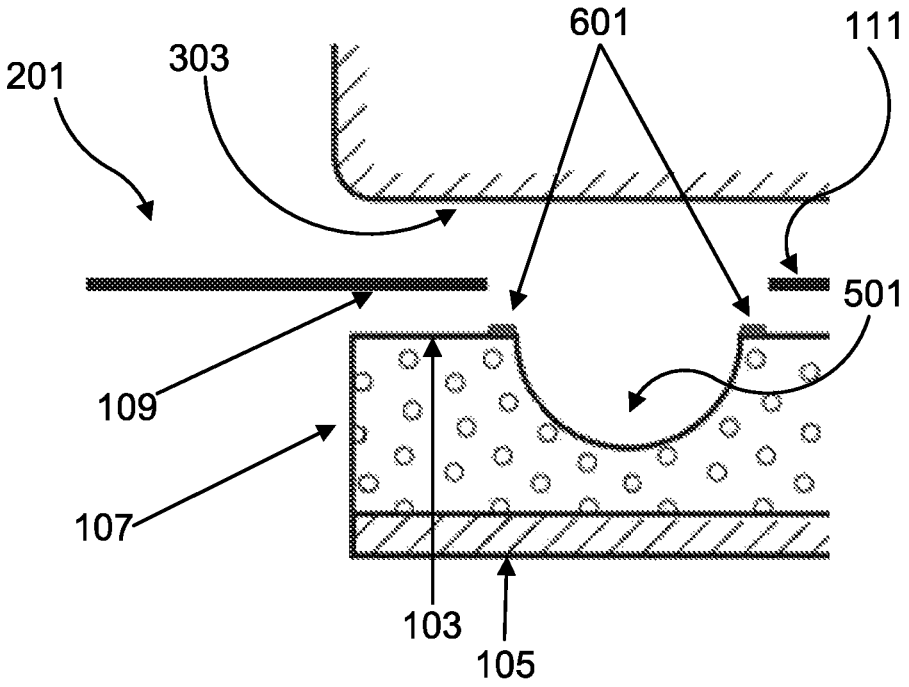
FIG. 13 is an enlarged cross-sectional view of the attachment of FIG. 12 illustrating the adhesive rings.

FIG. 13 is an enlarged cross-sectional view of an alternative version of the removable outsole cushion attachment 101 of FIG. 12 where the release layer 109 includes a tab 201. In this view, the attachment 101 is in a non-compressed state. The upper layer 103 includes a plurality of adhesive rings 601 lining a circumference of each of the plurality of cutouts 503 of the upper layer 103. The release layer 109 is configured to allow each of the plurality of adhesive rings 601 to releasably attach to an outsole 303 a shoe, while also allowing the adhesive portion 111 to releasably attach to the outsole 303. The tab 201 could be in the form of a loop (not shown) or other configuration, as long as it serves its purposes of being able to be grasped by a person and used to manually peel the attachment 101 from the outsole of her shoe or shoe covering.

Maintaining a sterile environment or reducing the spread of bacteria may be important for wearers of the attachment 101. As such, in some embodiments, the attachment 101 may be treated with an anti-bacterial substance to reduce the spread of bacteria, thus maintaining a sterile or more sterile environment. The attachment 101 may be coated with an antimicrobial agent, e.g., copper or its alloys, organosilanes, silver, chlorhexidine incorporated hydroxyapatite coatings, chlorhexidine-containing polylactide coatings on an anodized surface, polymer and calcium phosphate coatings with chlorhexidine, antibiotics, viral and fungal inhibitors.

Figure 14:
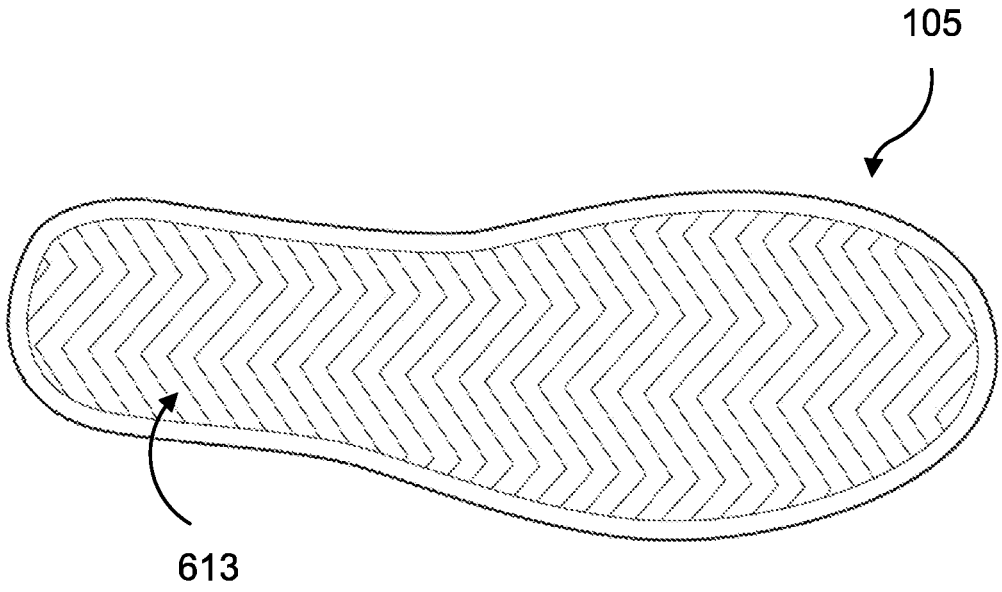
FIG. 14 is a bottom view of a lower layer of a removable outsole cushion attachment with a non-skid coating.

FIG. 14 is a bottom view of a lower layer 105 of a removable outsole cushion attachment of the present invention depicting a non-skid coating thereon. It may also be important to the user to avoid slips or falls while wearing the outsole cushion attachment 101. The outsole cushion attachment 101 is intended for use in environments where fluid is present, such as the ground surface or existing cushioning surfaces. Thus, the lower layer 105 in accordance with the removable outsole cushion attachments of the present disclosure may be configured to increase friction between the removable outsole cushion attachment 101 and a contact surface. For example, the lower layer 105 may be made of a rubber or any other suitable material to provide a non-skid surface and may also include an additional non-skid coating. The lower layer 105 may also include a tread pattern 613 to increase friction between it and the contact surface. The non-skid coating may be a polyethylene coating, or any coating that may reduce or eliminate slipping.

Figure 15:
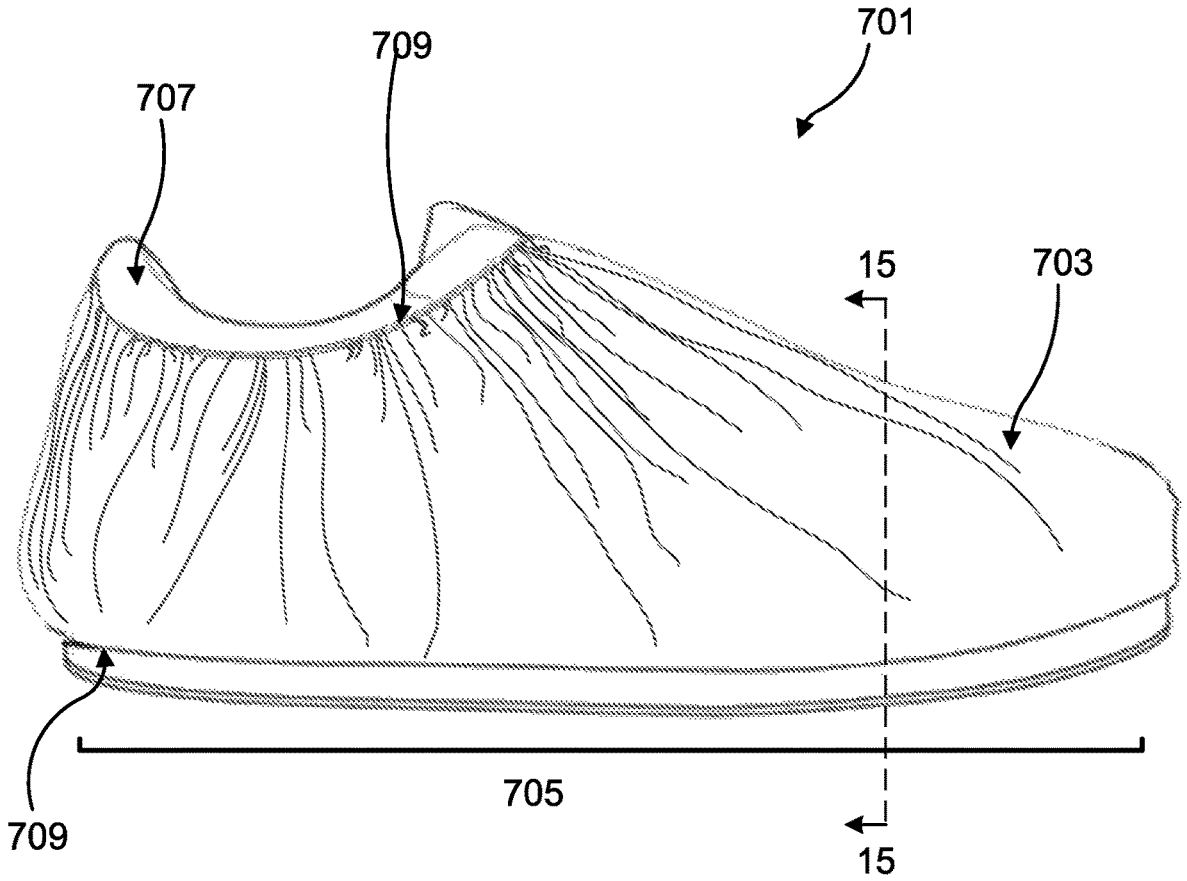
FIG. 15 is a side view of an embodiment of a disposable shoe cover with a cushioned bottom consistent with the present disclosure.

FIG. 15 is a side view of an exemplary embodiment of a disposable shoe cover 701 with a cushioned bottom 705 in accordance with one aspect of the invention. The disposable shoe cover 701 having a shoe cover body 703 configured to securely fit over footwear 707, such as a shoe. The shoe cover 701 may include a component 709 operable to securely maintain the shoe cover body 703 in contact with a shoe and in place so that the cushioned bottom 705 is aligned with an outsole of the shoe. The component 709 may be in the form of an elastic operable to allow wearer to stretch the shoe cover body 703 over the shoe. The component 709 may be a string, operable to allow a wearer to put the cover 701 over a shoe and then tie the string to secure the cover 701 over the shoe.

The cushioned bottom 705 may be any version of the removable outsole cushion attachment 101 described throughout the present disclosure. Similar to the removable outsole cushion attachment 101, the cushioned bottom 705 comprises a cushioning section 107. The cushioned bottom may also include an upper layer 103 and a lower layer 105, with a cushioning section 107 disposed between the upper layer 103 and lower layer 105. The shoe cover body 703 comprises an interior surface (not shown) for engaging the shoe 707 and an exterior surface. At least a portion of the interior surface is in direct contact with the shoe 707 when the shoe cover body 703 is fitted over the shoe 707. Here, the cushioned bottom 705 is attached to an exterior surface 711 of a bottom of the shoe cover body 703. In other embodiments of the shoe cover body 701, the cushioned bottom 705 may be attached to an interior surface of the shoe cover body or the cushioned bottom 705 may be integrated within the shoe cover body 703.

The shoe cover body 703 of may be configured to cover an entirety of a shoe, or may only cover a portion of a shoe, allowing a portion of the shoe to be exposed. In other embodiments, the shoe cover body 703 may be configured to provide coverage up to at least a calf of a wearer's leg. The shoe cover 701 is operable to securely fit the shoe cover body 703 over the shoe so that the cushioned bottom 705 is adequately aligned with the outsole of the shoe 707 and does not move while a wearer walks or stands while wearing the shoe cover 701.

The shoe cover body 703 may be of any material acceptable for a clean room or sterile room environment. For example, the material may be any non-woven fabric that filters particulates to maintain a sterile environment, a fluid repellent material, have a coating to repel fluid and/or bacteria. The material may be a polypropylene, rubber, latex, or combination thereof.

Figure 16:
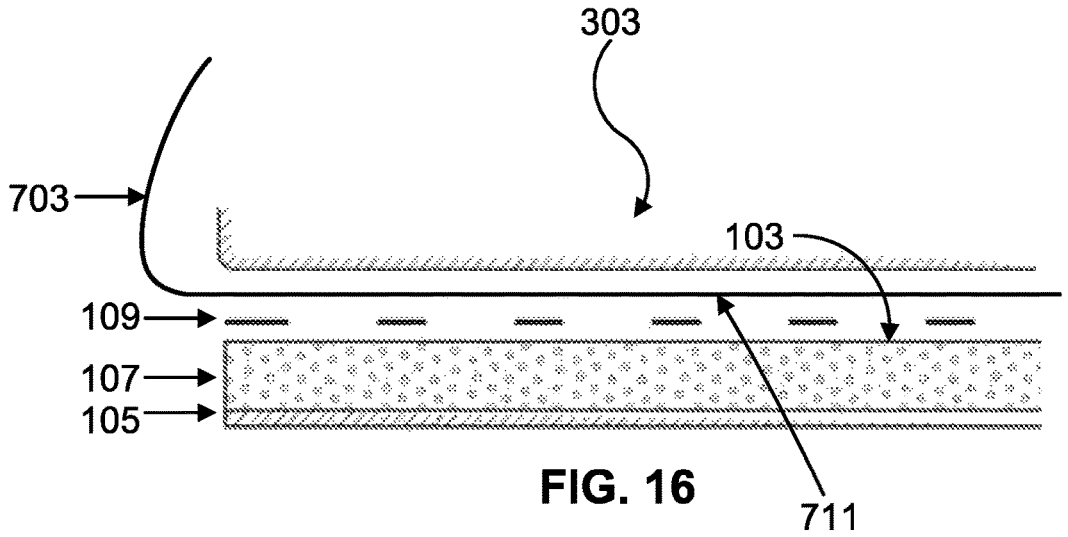
FIG. 16 is a cross-sectional view of the disposable shoe cover with a cushioned bottom taken along the lines 15-15 of FIG. 15.

FIG. 16 is a cross-sectional view of the disposable shoe cover 701 with a cushioned bottom 705 taken along the lines 15-15 of FIG. 15. The cushioned bottom 705 is attached to the exterior surface 711 (i.e., the outsole) of the shoe cover body 703. The cushioned bottom 705 may be permanently attached to the exterior surface 711 of the shoe cover body, or it may be releasably attached to the exterior surface 711 of the shoe cover body 703 via a release layer 109. The release layer 109 disposed on the upper layer 103. The release layer 109 may have an adhesive portion 111 configured to releasably attach to the exterior surface 711 (i.e., the outsole) of the shoe cover body 703, or the adhesive portion 111 may be configured to permanently attach to the exterior surface 711 (i.e., the outsole) of the shoe cover body 703. The shoe cover 701 may also include a tab (not shown).

Figure 17:
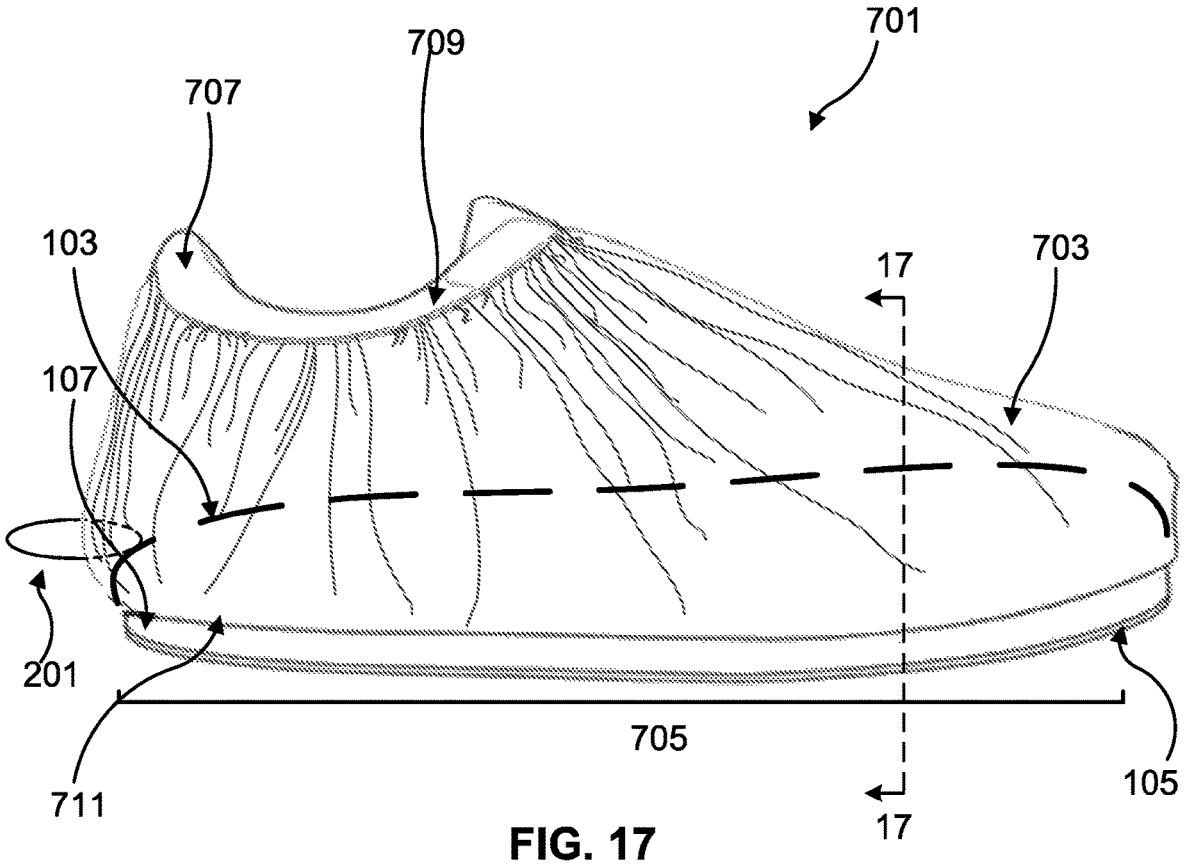
FIG. 17 is a side view of another embodiment of a disposable shoe cover with a cushioned bottom consistent with the present disclosure.

FIG. 17 is a side view of an alternative version of the disposable shoe cover 701 with a cushioned bottom 705 having a tab 201 extending through the body 703 of the shoe cover 701. The upper layer 103 of the cushioned bottom 705 of the disposable shoe cover 701 is positioned in contact with the interior surface (not illustrated) of the body 703 and the lower layer 107 is positioned on the exterior surface 711 (i.e., the outsole) of the shoe cover body 703. A portion of the cushioning section 107 may also be positioned along the exterior surface 711 of the bottom of the body 703. As such, the cushioned bottom 705 may be partially inside the shoe cover 701. The cushioned bottom 705 may be attached or integrated within the body 703 of the shoe cover 701. The cushioned bottom 705 may be sewn into the body 703 of the shoe cover 701. The cushioned bottom 705 may include a release layer 109 disposed on the upper layer 103. The release layer 109 may have an adhesive portion 111 configured to releasably attach to the outsole of a shoe. The release layer may also include a tab 201 that extends beyond an edge of the cushioned bottom 705 and through to the exterior surface of the body 703. The tab 201 could be in the form of a loop (not shown) or any other configuration, as long as it serves its purposes of being able to be grasped by a person and used to manually release the cushioned bottom 705 from the outsole of the shoe. The tab 203 may also serve the purpose of removing the shoe cover 701 from wearer's shoe. Thus, the wearer need not touch the exterior surface of the body 703 to remove the shoe cover 701 from the shoe.

Figure 18:
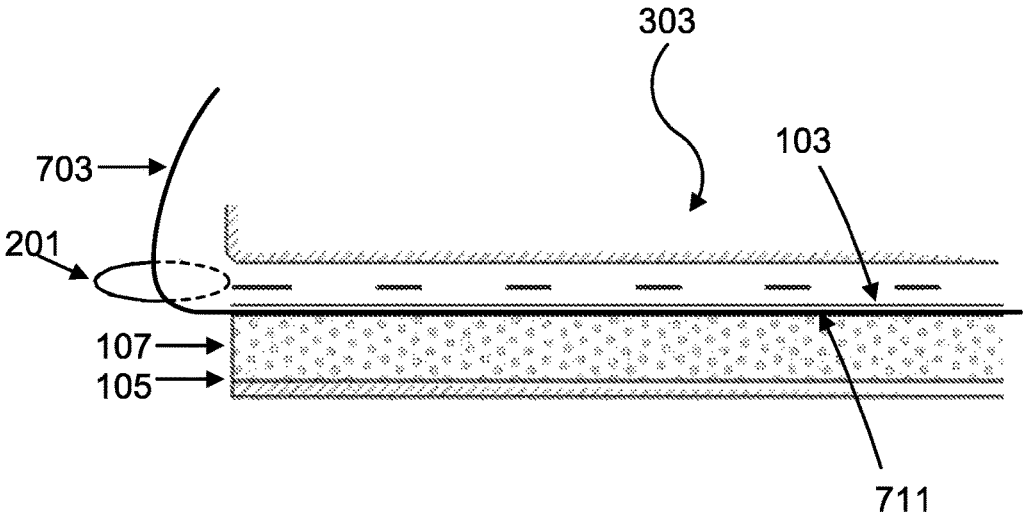
FIG. 18 is a cross-sectional view of the disposable shoe cover with a cushioned bottom taken along the lines 17-17 of FIG. 17.

FIG. 18 is a cross-sectional view of the disposable shoe cover 701 with a cushioned bottom 705 taken along the lines 17-17 of FIG. 17. The upper layer 103 of the cushioned bottom 705 is positioned in contact with the interior surface of the shoe cover body 703 and the lower layer 107 is positioned on the exterior surface of the shoe cover body. At least a portion of the cushioning section 107 is positioned on the exterior surface 711 the shoe cover body 703. The cushioned bottom 705 may be attached or integrated within the body 703 of the shoe cover 701. The cushioned bottom 705 may be sewn into the body 703 of the shoe cover 701. The release layer 109 may have an adhesive portion 111 configured to releasably attach to the outsole 303 of the shoe. The release layer may also include a tab 201 that extends beyond an edge of the cushioned bottom 705 and through to the exterior surface of the shoe cover body 703.

Figure 19:
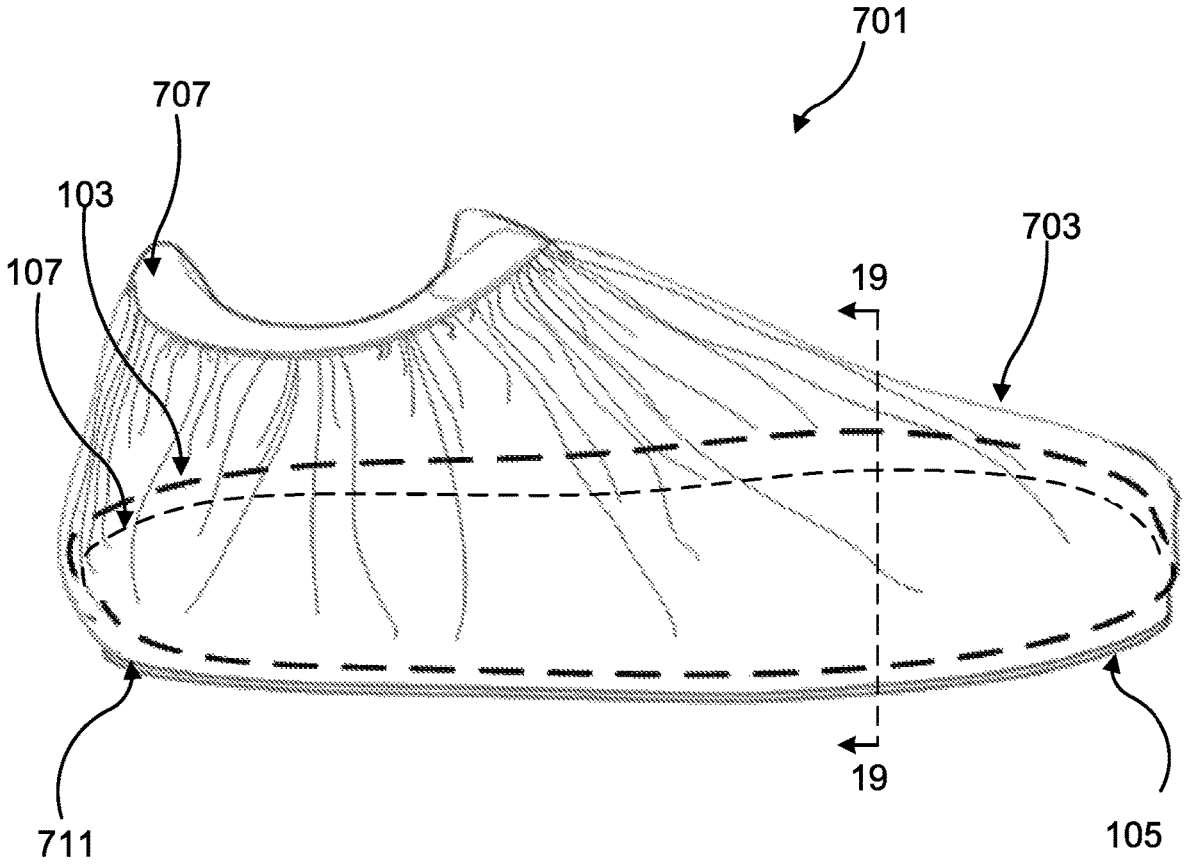
FIG. 19 is a side view of yet another embodiment of a disposable shoe cover with a cushioned bottom consistent with the present disclosure.

FIG. 19 is a side view of an alternative version of the disposable shoe cover 701 having the upper layer 103 and the cushion section 107 of the cushioned bottom 705 positioned in contact with the interior surface of the shoe cover body 703. The lower layer 107 is positioned on the exterior surface 711 along the bottom of the shoe cover body 703. The cushioned bottom 705 may also include a release layer 109 disposed on the upper layer 103. The release layer 109 may have an adhesive portion 111 configured to releasably attach the cushioned bottom 705 to the outsole of a shoe. The release layer 109 may also include a tab 201 that extends beyond an edge of the cushioned bottom 705. The tab 203 may be configured to extend through to the exterior surface 711 of the body 703, thus, allowing the wearer to remove the shoe cover 701 from the shoe without touching the body 703 of the shoe cover 701.

Figure 20:
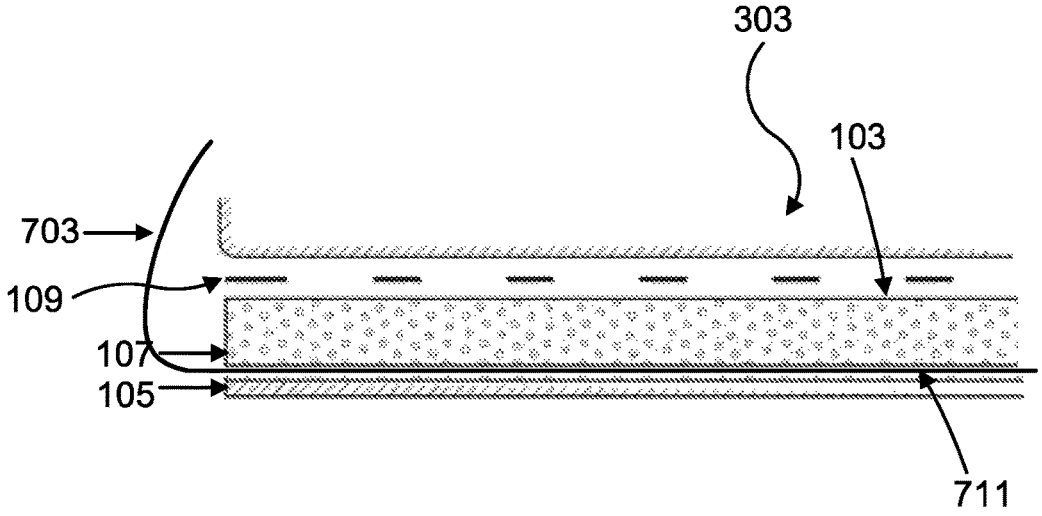
FIG. 20 is a cross-sectional view of the disposable shoe cover with a cushioned bottom taken along the lines 19-19 of FIG. 19.

FIG. 20 is a cross-sectional view of the disposable shoe cover 701 with a cushioned bottom 705 taken along the lines 19-19 of FIG. 19. The upper layer 103 and the cushion section 107 of the cushioned bottom 705 are positioned in contact with the interior surface of the shoe cover body 703. The lower layer 107 is positioned on the exterior surface 711 along the bottom of the shoe cover body 703. The cushioned bottom 705 may be attached or integrated within the body 703 of the shoe cover 701. The cushioned bottom 705 may be sewn into the body 703 of the shoe cover 701. The release layer 109 may have an adhesive portion 111 configured to releasably attach to the outsole 303 of the shoe. The release layer may also include a tab 201 that extends beyond an edge of the cushioned bottom 705 and through to the exterior surface of the shoe cover body 703.

Figure 21:
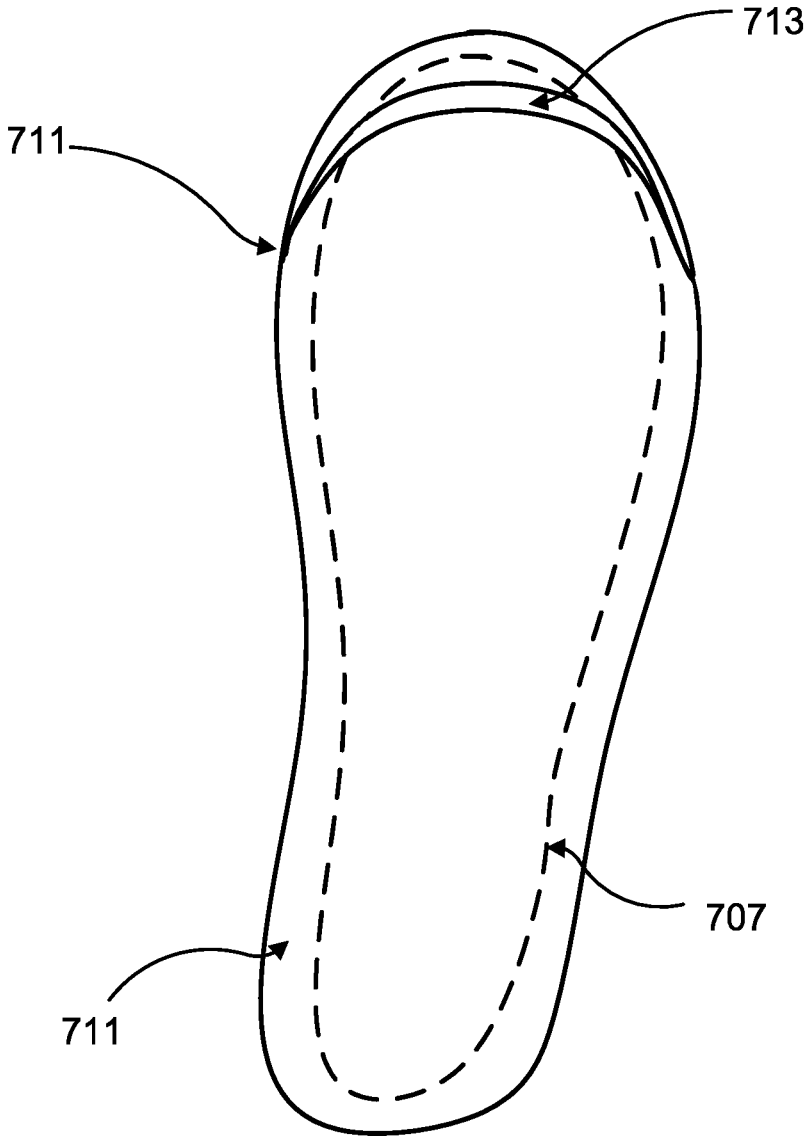
FIG. 21 is a bottom view of an exterior of a disposable shoe cove consistent with the present disclosure illustrating a pouch with a flap containing the cushioned sole therein.

FIG. 21 is a bottom view of an alternative version of the shoe cover 701 having the cushioned bottom 705 contained within a pouch 711 configured to fit the cushioned bottom 705 therein. The pouch may be positioned on the exterior surface 711 of the shoe cover body 703. Alternatively, the pouch may be positioned in the interior surface of the shoe cover body 703. The pouch 711 may be a closed pouch having the cushioned bottom 705 securely positioned therein prior to use. Alternatively, the pouch 711 may have a closable flap 713 or any other configuration, as long as it serves its purposes of allowing a user to insert the cushioned bottom 705 into the pouch and to securely close the pouch. The pouch may be securely closed by the user by either folding or sealing the pouch closed with an adhesive disposed thereon. At least a portion of the exterior surface 711 of the shoe cover 701 may be coated with a non-skid or non-slip coating. For example, the non-skid coating may be similar to the coating described above in FIG. 14.

The shoe cover 701 may be in separate components and require assembly. As such, the invention includes a shoe cover system. The shoe cover body 703 may be that of any shoe cover body configured to be placed over or on a wearer's shoe or foot. The wearer may affix the cushioned bottom 705 to the exterior surface 711 of the bottom of the shoe cover body 703 prior to placing the assembled shoe cover 701 over her shoe by adhering the adhesive portion 111 to the exterior surface 711 of the shoe cover. Alternatively, the shoe cover body may be placed over the wearer's shoe and then the wearer may affix the cushioned bottom 705 to the exterior surface 711 of the shoe cover body by adhering the adhesive portion to the exterior surface 711 of the shoe cover body 703 to complete assembly of the shoe cover 701. The cushioned bottom 705 may also include a protective layer or film over the adhesive portion to protect the adhesive portion 111 prior to use. Upon removal of the protective layer, the wearer may press the adhesive portion 111 of the cushioned bottom 705 onto the exterior surface 711 of the bottom of the shoe cover body 703 with either her fingers or by a stepping motion to securely adhere the cushioned bottom 705 to the exterior surface 711 of the shoe cover body 703 to complete assembly of the shoe cover 701.

Any of the embodiments of the invention can be used by people not in the healthcare field to achieve the benefit of eliminating or at least reducing the stress and fatigue associated with tasks that require prolonged static postural positioning and/or standing for a prolonged period of time.

Reference throughout this specification to "one embodiment" or "an embodiment" means that a particular feature, structure, or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents.

What is claimed is:

1. A disposable, single-use outsole cushion attachment releasably attachable to footwear, the attachment comprising:

an upper layer;

a release layer disposed on the upper layer, the release layer for releasably attaching the attachment to an outsole of the footwear;

a lower layer; and a cushioning section disposed between the upper and lower layers and comprising a plurality of cutouts defined along a top surface thereof, wherein each cutout comprises a concave hemispherical shape extending into a thickness of the cushioning section.

2. The attachment of claim 1, wherein the release layer comprises an adhesive portion configured to releasably attach the attachment to the outsole of the footwear.

3. The attachment of claim 1, wherein the release layer further comprises a tab that extends beyond an edge of the attachment and is configured to release the attachment from the outsole of the footwear.

4. The attachment of claim 3, wherein the tab is non-adhesive.

5. The attachment of claim 1, further comprising a trim line that indicates where to cut the attachment to make the attachment smaller.

6. The attachment of claim 1, further comprising a plurality of the trim lines.

7. The attachment of claim 1, wherein the cushioning section comprises a compressible material.

8. The attachment of claim 7, wherein the compressible material is formed from the group consisting of: polyether, polyesters, polyethylene, polyurethane, latex, cellulose, polypropylene, nitrile, vinyl, silicone, elastomers, and mixtures thereof.

9. The attachment of claim 8, wherein the compressible material is a gel or a foam.

10. The attachment of claim 8, wherein the compressible material is a thermoplastic elastomer.

11. The attachment of claim 8, wherein the cushioning section comprises at least one layer of the compressible material.

12. The attachment of claim 1, wherein the upper layer comprises a plurality of cutouts corresponding to the plurality of cutouts of the cushioning section and a plurality of adhesive rings lining a circumference of each of the plurality of cutouts of the upper layer.

13. The attachment of claim 1, wherein at least a bottom surface of the lower layer is comprised of a non-skid material so as to increase friction between the attachment and a contact surface.

14. The attachment of claim 1, wherein the attachment is treated with an anti-bacterial substance.

* * * * *